United States Patent [19]

Presley

[11] 4,455,770

[45] * Jun. 26, 1984

[54] TRENCHER POWER CONTROL SYSTEM

[76] Inventor: Glen T. Presley, 200 W. Industrial Dr., Angola, Ind. 46703

[ * ] Notice: The portion of the term of this patent subsequent to Jul. 6, 1999 has been disclaimed.

[21] Appl. No.: 395,576

[22] Filed: Jul. 6, 1982

Related U.S. Application Data

[63] Continuation-in-part of Ser. No. 139,864, Apr. 14, 1980, Pat. No. 4,337,587.

[51] Int. Cl.[3] ..... E02F 5/06

[52] U.S. Cl. ..... 37/86; 60/449

[58] Field of Search ..... 37/86; 60/449, 444

[56] References Cited

U.S. PATENT DOCUMENTS 3,605,903 9/1971 Glesmann ..... 37/86 X
3,943,715 3/1976 Miyao et al. ..... 60/449 X
3,981,374 9/1976 Johns, Jr. ..... 60/449 X
4,180,979 1/1980 Cornell ..... 60/449 X
4,337,587 7/1982 Presley ..... 37/DIG. 1

*Primary Examiner*—Clifford D. Crowder

[57] ABSTRACT

An automatic horsepower control system on a working vehicle which varies the vehicle drive speed so as to maintain a maximum torque output on the working function of the vehicle. The prime mover of the vehicle drives the work function and also a pump which in turn supplies motordriven wheels for moving the vehicle. A stroker control cylinder controlled by a solenoid operated valve varies the pump flow rate to the motor to change vehicle speeds, said solenoid operated valve being signaled by an electronic controller which compares the prime mover's RPM with a standard to determine the torque load from the work function, and accordingly signals the valve to increase or decrease the flow to the motor to adjust vehicle speed and maintain a constant work load on the prime mover.

2 Claims, 1 Drawing Figure

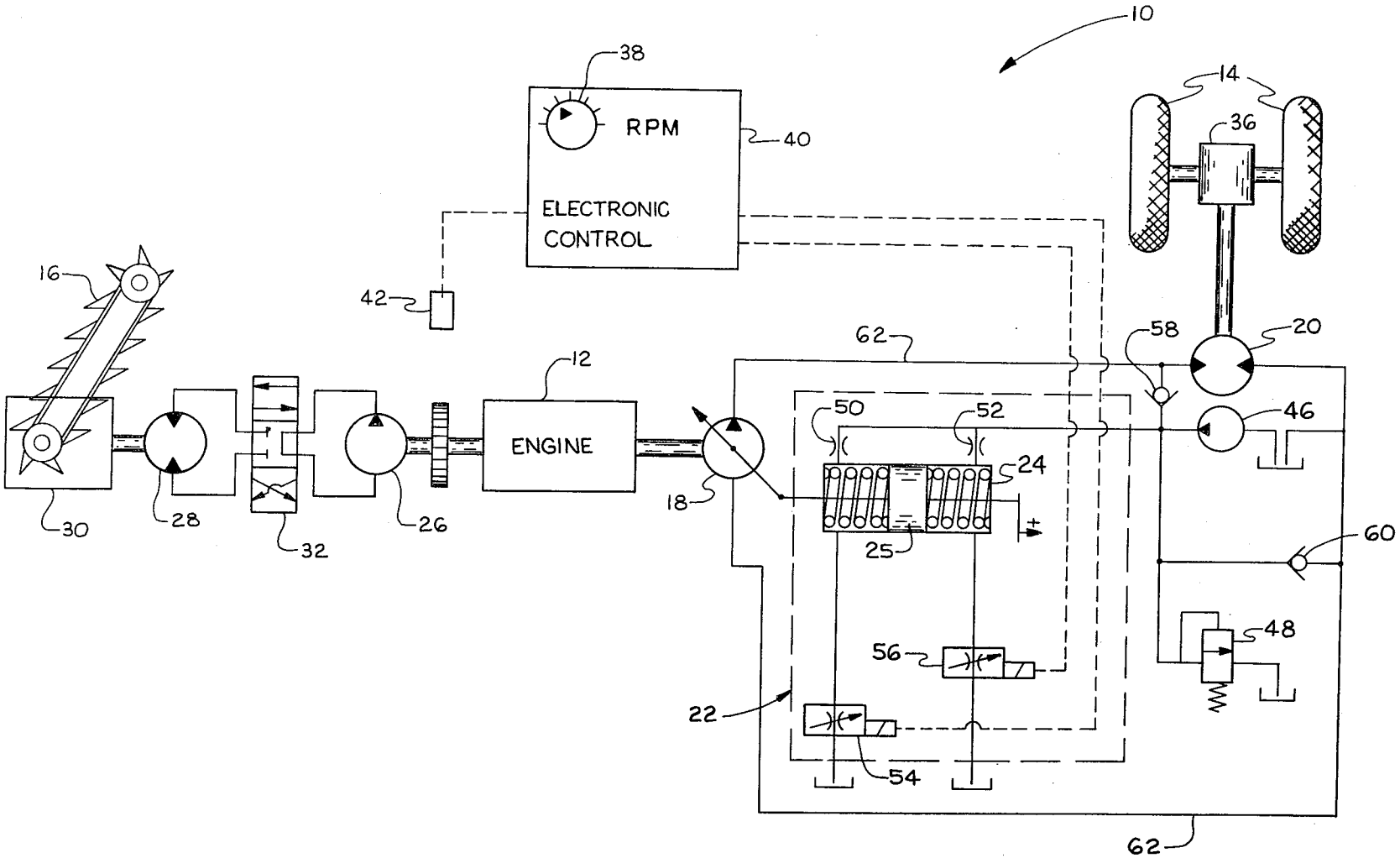
10
14
36
20
46
60
48
58
62
24
52
25
50
56
54
22
18
40
RPM
ELECTRONIC
CONTROL
38
12
ENGINE
42
26
32
28
30
16

TRENCHER POWER CONTROL SYSTEM

This is a continuation-in-part of application Ser. No. 139,864 filed Apr. 14, 1980, issued as U.S. Pat. No. 4,337,587 on July 6, 1982.

BACKGROUND OF THE INVENTION

For many years vehicles have been built wherein the prime mover drives the work function of the vehicle along with propelling the vehicle. Machines of this type would include trenchers, forage harvesters, tillage machines and any other type of machine which moves along as it performs its work function. In the case with most of these machines, and particularly a trencher, the machine does not have enough power to operate its digging mechanism while propelling the machine at its maximum ground speed. Therefore, the operator must listen to the engine, or watch the engine RPM while manually varying the ground speed of the trencher to keep the engine loaded, but at the same time not to overload the engine causing it to stall. This type of manually adjusted system has proven fairly successful, but requires a skilled operator to make constant speed correction to realize anywhere near optimum machine performance. A lesser-skilled operator obviously cannot run the machine at anywhere near its peak capacity. Quite often the operator sets the ground speed at some value whereby the engine horsepower used is substantially less than the maximum, and lets the machine operate at this speed, thus not utilizing the full capabilities of the machine.

The present invention provides an automatic system wherein the ground speed of the vehicle is automatically regulated instantaneously so that the full horsepower capacity of the machine is utilized at all times, even though the resistance to digging is constantly changing. The control of the present invention adjusts the ground speed of the machine to keep the engine operating at a substantially constant horsepower at all times. As the digging mechanism encounters softer soil, the machine will increase its ground speed which in turn increases the load or torque on the engine. Likewise, when the digging mechanism engages harder soil it slows down its ground speed just enough to maintain an essentially constant RPM.

It is therefore a principal object of the present invention to provide an automatic horsepower control system which varies the vehicle speed so as to maintain a constant work load torque under varying conditions.

Another object of the present invention is to provide a trencher drive system which varies the vehicle speed in accordance with the digging resistance encountered.

The advantages and objects of the invention will become evident from the following detailed description of the drawing when read in connection with the accompanying drawing which illustrates a preferred embodiment of the invention.

BRIEF DESCRIPTION OF THE DRAWING

The drawing is a schematic diagram of the horsepower control system of the present invention utilized on a trencher.

Turning now more particularly to the drawing, there is illustrated the horsepower control system of the present invention generally identified by reference numeral 10. The system includes a prime mover or engine 12 which drives the vehicle wheels 14 and the digging mechanism 16. Prime mover 12 drives a variable displacement pump 18 which supplies a vehicle drive motor 20. Stroker control 22 varies the displacement of pump 18 to control the vehicle drive speed through two solenoid powered variable orifices 54 and 56.

Prime mover 12 also drives the principal work function, which is digging chain 16 in the drawing, through a second pump 26 and digging motor 28. Motor 28 drives digging chain 16 through a conventional gear reduction box 30. The chain drive circuit is a closed loop flowing through a conventional three-position four-way valve 32 which either returns the flow to pump 26 or directs it to either side of motor 28 with the return from motor 28 flowing back to the return side of the pump 26.

The vehicle speed is controlled by a closed loop hydraulic circuit wherein variable pump 18 supplies motor 20 in either direction depending on the desired direction of movement. Wheel drive motor 20 in turn drives wheels 14 through a conventional gear box and differential 36. Stroker control 22 is controlled by electrical signals from a electronic control 40 which controls solenoids 54 and 56. The stroker 22 includes a positioning cylinder 24 having a piston 25 which is spring-biased to a center neutral position, as illustrated in the drawing, (zero pump displacement). Charging pump 46 supplies pressure to both chambers of positioning cylinder 24 across fixed orifices 50 and 52. Variable orifices 54 and 56 control the drain flow from the two chambers of cylinder 24 and with no voltage flowing to either solenoid, the variable orifices are sufficiently open that the pressure in the cylinder chambers is zero. Electronic controller 40 includes an RPM reference 38. The prime mover or engine 12 has a sensor 42 located on the engine drive shaft for sensing RPM of the engine. Sensor 42 supplies an electrical signal to control 40, which in turn compares the actual RPM signal with a reference so as to determine the loading on engine 12. Sensor 42 could be either a magnetic type as well as various other types of commonly known speed sensors. While the trencher drive means is shown as a closed hydraulic circuit, it could also be a direct drive mechanical means through a gear box or chain drive.

OPERATION

The resistance to digging chain 16 depends on a variety of factors including soil conditions, depth and most important horizontal speed through the ground. If the horizontal speed of the trencher is stopped, the digging chain 16 will merely pass through previously dug ground with the load on the chain diminishing substantially. As the horizontal digging speed is increased, the torque loading on digging chain 16 increases the faster it engages undisturbed earth.

Initially the trencher operator will set the mechanical throttle of engine 12 at an RPM which will be greater than the RPM level of reference 38. As the trencher begins to dig, motor 12 will slow down due to the digging load from chain 16. As long as the actual engine RPM stays at the reference 38, control 40 will not signal the stroker 22 to increase or decrease the amount of flow to drive wheel motors 20. When the actual engine speed exceeds the pre-set reference 38, the controller 40 signals stroker 22 to increase the flow to motor 20 and increase the trencher speed across the ground. Controller 40 achieves this by applying a voltage to solenoid 54, which closes down variable orifice 54 and builds pressure in the left chamber of positioning cylinder 24. This pressure in the left chamber moves the piston 25 to the right until the force of the spring in the right chamber balances the hydraulic force in the left chamber. The pressure developed in the left chamber is proportional to the voltage input to the solenoid, so the stroker control is proportional to voltage input since the pressure is acting against the spring in one chamber or the other. Applying voltage to the opposite solenoid 56 moves the piston 25 in the opposite direction, to the left, and reverses the direction of flow in pump 18, causing the trencher motor 20 to move the trencher backwards. Charge pump 46 supplies oil to both chambers of positioning cylinder 24, as well as providing make-up fluid in the closed loop drive circuit 62 across check valves 58 and 60.

When the trencher engages lightly packed soil, the reduced loading on chain 16 allows the engine speed to increase until it exceeds the reference 38 at which time electronic control 40 signals stroker 22 to increase the flow to motor 20 and in turn the vehicle speed. This electrically-sensed adjustment to the hydraulic system takes place very quickly, in a fraction of a second, on the order of 1/800th of a second, which is much faster than any human adjustment could be made. With a set throttle speed on motor 12, and a pre-selected standard 38, the operator can set the trencher control system 10 to a constant horsepower output regardless of the terrain conditions encountered. Operating a trencher at its maximum horsepower output with a system of this nature can increase the output of the trencher thirty percent over that of any manually controlled trencher with a skilled operator. The speed of sensing and adjusting stroker 22 is so quick that the actual engine RPM will appear to the human ear to remain constant even though a wide range of digging conditions are being encountered. By adjusting the system every 1/1000th of a second, systems which are operating at peak horsepower are allowed to maintain their peak power point (on a horsepower curve) under changing conditions.

Having described the invention with sufficient clarity to enable those familiar with the art to construct and use it, I claim:

1. A trencher control system which varies the vehicle drive speed so as to maintain a preset torque on the digging chain as the digging conditions vary, comprising:

a prime mover;

a drive means connecting the prime mover to the digging chain;

a variable displacement pump means driven by the prime mover;

a stroker control means attached to the pump means to control the pump displacement level, including a stroker control cylinder having at least one working chamber defined by a piston in said cylinder which is spring-biased toward a neutral zero flow position; a charge pump connected to said chambers of the cylinder, a fixed orifice positioned between the charge pump and each chamber; a drain line connecting each chamber to drain, a solenoid controlled valve means positioned in each of said drain lines which varies the pressure level in said chambers;

a vehicle drive motor connected to the drive wheels of the trencher, said motor being driven by said pump means;

RPM sensing means on the prime mover;

an electronic control means which controls the solenoid of the valve means, the control means receives a signal from the prime mover RPM sensing means and compares the signal with an adjustable reference, if the signal received is less than the reference, the control means signals the solenoid to decrease the pressure level in the working chamber and decrease the pump displacement; if the signal is greater than the reference, the control means signals the solenoid to increase the pressure level in the working chamber and increase the pump displacement and further load the prime mover, whereby the control means maintains the prime mover at its peak torque output regardless of changes in the digging conditions.

2. A trencher control system as set forth in claim 1, wherein the electronic control means sends signals to the stroker control means at a time interval between 1/100 and 1/1000 of a second.

* * * * *